United States Patent [19]

Johnson et al.

[11] 4,176,346

[45] Nov. 27, 1979

[54] SMOKE ALARM NETWORK

[75] Inventors: Arven Johnson, Kansas City, North; Willene Stapleton, Platte City, both of Mo.

[73] Assignee: John O. Stapleton, Platte City, Mo.; a part interest

[21] Appl. No.: 853,119

[22] Filed: Nov. 21, 1977

[51] Int. Cl.[2] ..... G08B 25/00; G08B 17/10

[52] U.S. Cl. ..... 340/524; 340/628

[58] Field of Search ..... 340/504, 524, 525, 628, 340/629, 630, 584

[56] References Cited

U.S. PATENT DOCUMENTS

| | | | |
|---|---|---|---|
| 2,520,340 | 8/1950 | Robinson | 340/630 |
| 3,537,105 | 10/1970 | Tellerman | 340/504 |
| 3,794,765 | 2/1974 | Goodwater | 179/1 SW |
| 3,909,814 | 9/1975 | Eguchi | 340/629 X |
| 3,952,808 | 4/1976 | Richardson | 340/628 X |
| 4,064,368 | 12/1977 | Dibner | 179/5 R |
| 4,067,004 | 1/1978 | Gulbrantson | 340/524 |
| 4,074,225 | 2/1978 | Vanderweghe | 340/628 X |

FOREIGN PATENT DOCUMENTS 1351748 5/1974 United Kingdom ..... 340/514

OTHER PUBLICATIONS

The "Vigilante", Bulletin #MZ-100-A, Entronic Corporation.

*Primary Examiner*—John W. Caldwell, Sr.
*Assistant Examiner*—Daniel Myer
*Attorney, Agent, or Firm*—Fishburn, Gold & Litman

[57] ABSTRACT

A smoke alarm network for buildings and the like comprises a plurality of stations having a smoke detector alarm unit installed in each. Station switching members are connected at each station, and a central control panel is provided with switching members connected with each of the stations and responsive to identifiably indicate alarm signals sent by the station detectors to the control panel. An alert switch is mounted on the control panel and is operably connected with each detector-alarm unit for selectively activating the alarm positioned at one or more of the stations.

10 Claims, 4 Drawing Figures

SMOKE ALARM NETWORK

FIELD OF THE INVENTION

The present invention relates to fire protection systems and more particularly to a smoke detector system employing smoke detector-alarm units in a dual role of a sensor-local alarm and a remotely actuated alarm.

BACKGROUND OF THE INVENTION

In recent years fire protection devices, known as smoke detectors or smoke alarms, have been developed. These devices, especially a type known as the ionization type of smoke detector, are very effective in sensing the airborne products of combustion at an early stage in the development of a fire. The device then activates a sounding device to warn persons in the vicinity of impending danger.

Smoke alarms, in general, have a limited area of effective monitoring and are ordinarily intended for use in dwellings, for example, in the hall of a house having bedrooms adjoined thereto. Certain types of these alarms may be employed in multiples for use in larger households, wherein they may be interconnected so that if one unit detects smoke, all of the alarm units are activated for warning all the occupants of the house. Generally, those smoke alarms which are designed for the above described interconnected use have an accessible socket for interconnection thereto, since fire regulations for such devices generally discourage connection to the internal circuitry of the detector-alarm unit.

It has been found on the multiple pin socket that certain pins have an electrical output thereon when the smoke alarm is triggered by detection of smoke. This output is the driving power for the sounding device and may be measured as a voltage with a current delivery capability. It has also been found that the interconnection of certain pins of the socket will cause the sounding device to be activated in the absence of smoke.

The present invention is a network of such smoke alarm units, connected with a control panel and including switching members, that makes use of the socket conditions of the above described type of smoke alarm unit. The network of the present invention is a two-way system in that the smoke alarm units communicate alarm signals to the control panel while switch members on the control panel are operable to send alert signals to the smoke alarm units.

SUMMARY OF THE INVENTION

The principal objects of the present invention are: to provide a smoke alarm network comprising a plurality of smoke alarm units interconnected with a control panel; to provide such a network interconnected so that alert signals may be sent from the control panel to the smoke alarm units; to provide such a network wherein the control panel includes indicators for determining the origin of an alarm signal; to provide such a network including interlocking means to prevent the sending of an alert signal to a smoke alarm that has been activated by the detection of smoke or, conversely, to prevent an alerted smoke alarm unit from sending an alarm signal to the control panel; to provide such a network which does not damage or decrease the reliability of the smoke alarm units employed therewith; to provide such a network in which there is isolation between the power system of the network and the power systems of the smoke alarm units; to provide such a network which is expandible for protecting any number of separated areas; to provide such a network including switches for testing the individual smoke alarm units without sending an alarm signal to the control panel; to provide such a network in which switches can be installed in locations remote from the control panel; to provide such a network to which a duplicate control panel, identical to the main control panel, may be connected and installed at a location remote from the main control panel; to provide such a smoke alarm network which is economical to manufacture, durable and reliable in operation, and which is particularly well adapted for its intended purpose.

Other objects and advantages of this invention will become apparent from the following description taken in connection with the accompanying drawings wherein are set forth, by way of illustration and example, certain embodiments of this invention.

The drawings constitute a part of the specification, include an exemplary embodiment of the present invention, and illustrates various objects and features of the smoke alarm network.

Figure 1:
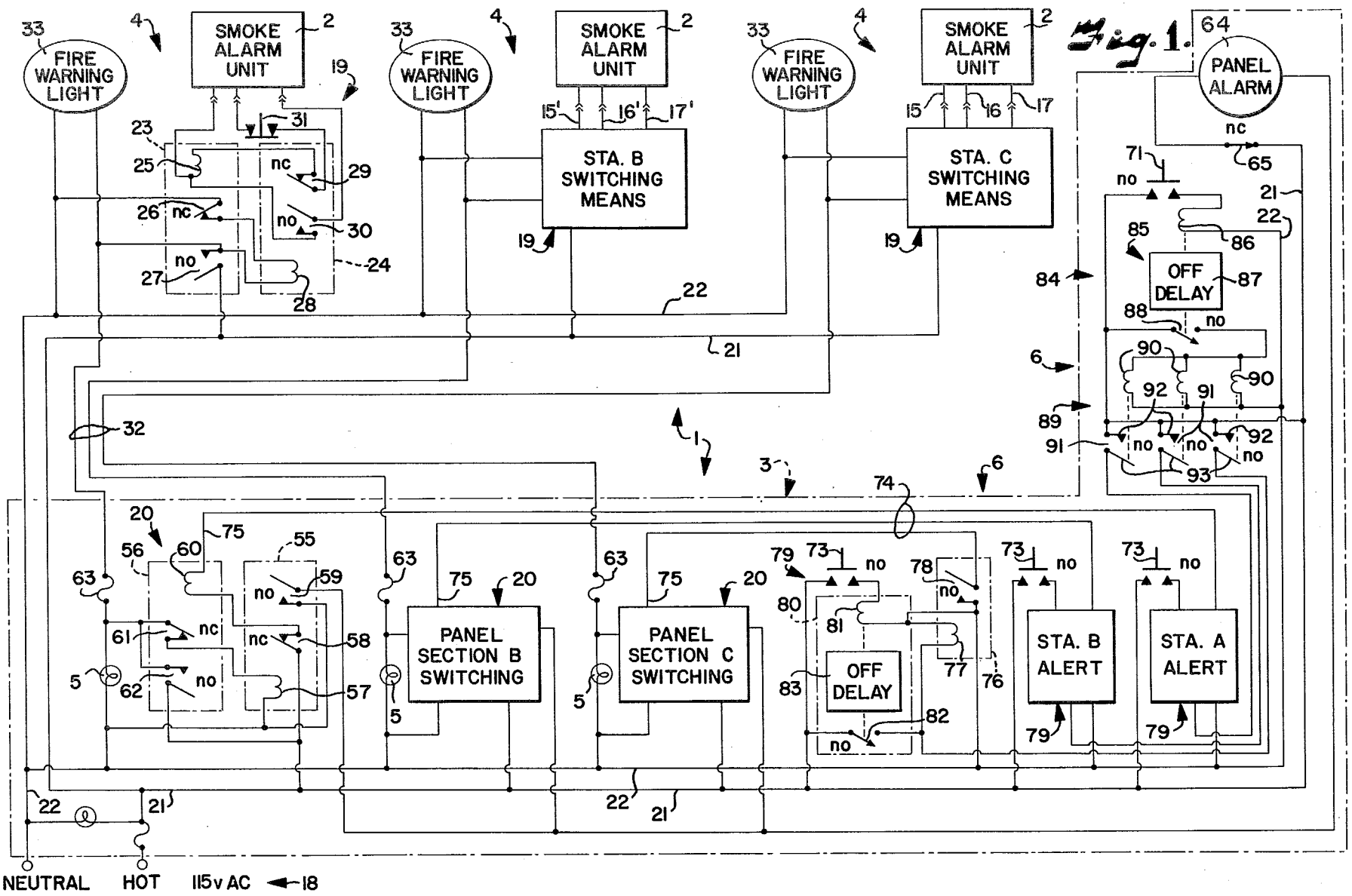
FIG. 1 is a schematic diagram, partly in block form, of the components of the smoke alarm network of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

DESCRIPTION OF THE PREFERRED EMBODIMENTS

Referring to the drawings in more detail:

The reference numeral 1 generally designates a smoke alarm network for use with a plurality of smoke alarm units 2 interconnected with a control panel 3 and communicating alarm signals thereto in response to detection of smoke by the smoke alarm units 2. The smoke alarm network 1 is adapted to provide fire protection to a plurality of stations 4 (FIG. 1), each having at least one of the smoke alarm units 2 installed in association therewith. For the purpose of this invention, a station may be defined as an area that can be effectively monitored by the smoke detector or an area in which an activated smoke detector can effectively be heard, such as suites in a hotel, offices in a building, or specific areas in a large open room, such as, in a warehouse. The control panel 3 includes alarm indicators or alarm location lights 5 corresponding to each station 4 and activated in response to detection of smoke by the smoke alarm unit 2 of a respective station 4, thereby giving the origin of the alarm signal. The control panel 3 also includes alert means, indicated generally at 6 on FIG. 1, operable to cause activation of the smoke alarm units 2 for the purpose of alerting occupants or persons at the stations 4.

The smoke alarm network 1 may be used with any type of smoke detector or alarm unit which has a suitable electrical output. The smoke alarm unit may include a type of smoke sensing unit with electrical circuitry for generating an output in response to the detection of smoke. Such a type of smoke detector unit may be used in the network 1 with an external or non-integral type of sounding unit. The smoke alarm network 1 is particularly adapted for use with commercially available smoke detector-alarm units having a smoke sensor, a sounding unit, and associated circuitry mounted in a common housing such as is illustrated schematically in FIG. 2.

Figures 2, 3:
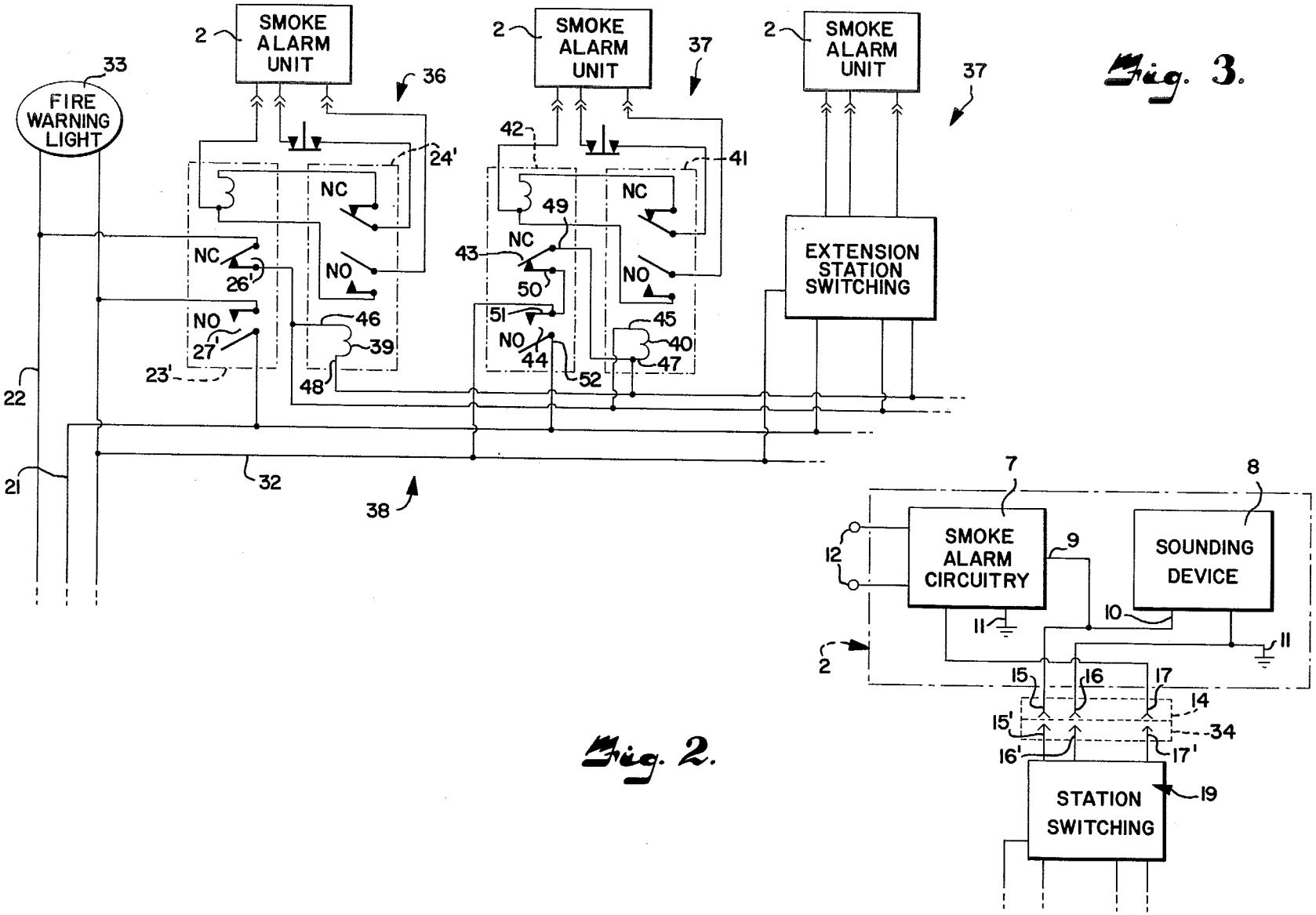
FIG. 2 is a block diagram of a representative type of smoke alarm unit for use with the smoke alarm network.
FIG. 3 is a schematic diagram, partly in block form, of a multiple station of the smoke alarm network, showing a master station and a plurality of extension stations.

The smoke alarm unit 2 illustrated in FIG. 2 is a conventional type of smoke detector unit and includes smoke alarm circuitry 7 including a power supply, smoke sensing means, and circuitry for generating an output in response to detection of smoke. The smoke detector 2 includes a sounding device 8 built into the smoke alarm unit 2 and connected therewith. The smoke alarm unit circuitry 7 includes an output terminal 9 connected to an input terminal 10 of the sounding device, and develops a voltage thereon whenever the smoke alarm unit circuitry 7 is activated in response to the detection of the presence of smoke or products of combustion. The smoke alarm unit 2 includes a common connection or chassis ground 11 connected to the smoke alarm unit circuitry 7 and to the sounding device 8, and completing the circuit between the smoke alarm unit circuitry 7 and the sounding device 8. Smoke alarm units such as the unit 2 may be designed either for battery power or for connection to an A.C. power source. The power input for the smoke alarm unit 2 is applied at a pair of power-in terminal 12 as shown in FIG. 2.

The smoke alarm unit 2 includes a socket or terminal block 14 having terminals thereof connected to the internal circuitry of the smoke alarm unit 2. The socket 14 is readily accessible and is normally intended for connecting a plurality of smoke alarm units 2 together such that if one smoke alarm unit detects smoke, all of the interconnected sounding devices are activated. Use is made of the socket 14 in the smoke alarm network 1 for sending alarm signals from the smoke alarm unit to the control panel 3 and for sending alert signals from the alert means 6 of the control panel to the smoke alarm units 2. The use of a smoke alarm unit 2 having an easily accessible socket 14 is preferable in the present invention, for ease of assembly and since connections to the internal circuitry is considered as tampering by the manufacturer and might be prohibited by fire regulations.

The socket 14 may include a plurality of terminals, and, for the illustrated invention, includes terminals 15, 16, and 17. The output terminal 15 is connected to the output terminal 9 of the smoke alarm unit circuitry 7 and to the input terminal 10 of the sounding device 8. The common terminal 16 is connected to the chassis ground 11. Whenever the smoke alarm unit 2 is in a ready or operative state, and detects the presence of smoke, there is a voltage on the output terminal 15 with respect to the common terminal 16, with a certain current delivering capability. This voltage or electrical output on the terminals 15 and 16 is the driving power for the sounding device 8, and may be used as a control signal for energizing or actuating components of the smoke alarm network 1.

The alert terminal 17 is connected to the smoke alarm unit circuitry 7 and has a voltage or output thereon whenever the smoke alarm unit 2 is in a ready state. The voltage on the terminal 17 is the same as that on the output terminal 15, however, the electrical output on the terminal 15 only occurs in the presence of smoke detection by the smoke alarm unit circuitry 7. In the absence of smoke detection by the smoke alarm unit circuitry 7, the sounding device 8 may be activated by connection of the terminal 17 to the output terminal 15. Use is made of this ability of the sounding device 8 to be activated in the absence of smoke, for sending an alert signal to the smoke alarm unit 2 from the alert means 6 of the control panel 3. A switch for connecting the terminals 15 and 17 that may be remotely activated by the alert means 6 is required.

A representative type of smoke alarm unit which may be used with the smoke alarm network 1 is the model Z-100 Smoke Alarm Unit manufactured by the Entronic Corporation of Earth City, Mo.

The smoke alarm network 1 requires connection to a source of electrical power. The network power source 18 may be any convenient power source compatible with the components of the network, and in the illustrated embodiment, the power source is conventional 115 volt alternating current.

Alarm signal and alert signals in the present invention may take any form and level consistent with the components employed therein, and any type of logic elements may be employed for processing these signals. The signal processing elements in illustrated network 1 are generally designated as station switching means 19 and panel switching means 20. The switching means 19 and 20 are controlled switches and may be either relays or any of various solid state devices. In the network illustrated, the switching means 19 and 20 are conventional relays. While the station switching means 19 and panel switching means 20 could both be mounted at the control panel 3, it has been found more convenient to mount the station switching means 19 at each station 4.

The relays employed in the switching means 19 and 20 are preferably miniaturized relays for space saving, and generally include an operating solenoid, a set of normally closed contacts, and a set of normally open contacts. While the network power of 115 volts could be transformed to a lower voltage, it has been found convenient to employ the full 115 volts because of its easy availability and to avoid employing extra components in the form of step-down transformers. Therefore, the alarm signals and alert signals in the smoke alarm network 1 exist on ON-states at 115 volts and OFF-states at zero volts. In the smoke alarm network 1, the network power source 18 is accessible to the components as a hot power bus 21 and a neutral power bus 22.

With reference to FIG. 1, each station switching means 19 includes a send switching portion or relay 23 and a receive switching portion or relay 24. Each send relay 23 includes an operating solenoid 25, a set of normally closed (NC) contacts 26, and a set of normally open (NO) contacts 27. Similarly, each receive relay 24 includes an operating solenoid 28, a set of normally closed (NC) contacts 29, and a set of normally open (NO) contacts 30.

As illustrated in FIG. 1, one side of the send relay solenoid 25 is connected to the output terminal 15 of the smoke alarm unit 2. The other side of the solenoid 25 is connected to one of the normally closed contacts 29 of the receive relay 24. The other of the NC contacts 29 is connected to the common terminal 16 of the smoke alarm unit 2. Preferably a normally closed test switch 31 is included between the common terminal 16 and the normally closed contact 29 for performing tests on the smoke alarm unit 2 without the sending of an alarm signal to the control panel 3. One side of the normally open contacts 27 of the send relay 23 is connected to the hot power bus 21. The other side of the NO contacts 27 is connected to one side of the solenoid 28 of the receive relay 24 and to a send-receive line 32. One of the send relay NC contacts 26 is connected to the other side of the receive relay solenoid 28. The other NC contact 26 is connected to the neutral power bus 22. The output terminal 15 of the smoke alarm unit 2 is connected to the alert activating terminal 17 through the normally open pair of contacts 30 of the receive relay 24.

The send relay solenoid 25 must be matched to the output voltage of the smoke alarm unit 2. Whenever one of the smoke alarm unit 2 detects the presence of smoke, a voltage appears on the output terminal 15 and the common terminal 16 thereof. This output voltage energizes the send relay solenoid 25 which in turn changes the state of the normally closed and normally open contacts 26 and 27 respectively. When the normally open contacts 27 close, 115 volts is connected to the send-receive line 32 thereby constituting an alarm signal. Since one side of the receive relay solenoid 28 is connected through the normally closed contacts 26 to the neutral power bus 22, opening of the normally closed contacts 26 prevents activation of the receive relay 24 whereby it is impossible for a station switching means 19 to both send an alarm and receive an alert.

When the contacts 26 and 27 are in their normal state, that is, in the absence of smoke detection by the smoke alarm unit 2, the receive relay solenoid 28 may be energized by an alert signal in the form of 115 volts on the send-receive line 32. Such energization of the solenoid 28 changes the state of the contacts 29 and 30. Closure of the normally open contacts 30 connects the output terminal 15 of the smoke alarm unit 2 with the alert activating terminal 17 thereby activating the sounding device 8 of the smoke alarm unit 2. Opening of the normally closed contacts 29 prevents energization of the send relay solenoid 25, thereby preventing the sending of an alarm signal by the smoke alarm unit 2 whenever the solenoid 28 is energized.

Preferably, each station 4 includes a fire warning light 33 connected to the neutral power bus 22 and to the send-receive line 32. The fire warning light 32 is preferably installed immediately outside of the station 4, and is activated in the event of an alarm signal sent from that station and in the event that an alert signal is received by that station. The purpose of the fire warning light 33 is to warn occupants or persons immediately outside of a station of impending danger without the necessity of those persons being close enough to hear the sounding device 8 of the smoke alarm unit 2. Preferably, the fire warning light is a type of lamp which begins to flash after being on for a given length of time for added visibility.

Preferably, each station 4 includes a plug 34 (see FIG. 2) including pins 15', 16', and 16' operatively connected to the station switching means 19 and receivable in the socket 14 of a respective station smoke alarm unit 2.

Before describing the remainder of FIG. 1, a modification of the basic station circuitry will be described. FIG. 3 illustrates a master station 36 and a plurality of extension stations 37. The purpose of the master-extension station arrangement is for the protection of an area so large that a single smoke alarm unit could not effectively monitor the area. A master station 36 with its respective extension stations 37 constitutes a multiple station 38, and includes a single fire warning light 33 and a single send-receive line 32. The master station and the extension station both include the send relay 23 and the receive relay 24 as described for the single station 4; however, the interconnection of components is different.

The components of the master station send and receive relays, respectively 23' and 24', are connected exactly as the respective components of the station 4, with the exception of a master station receive relay solenoid 39. One side of the solenoid 39 is connected to one of the send relay normally closed contacts 26' as in the station 4. The other side of the solenoid 39 is not connected to the send relay normally open contacts 27'. The solenoid 39 is connected in parallel with solenoids 40 of the receive relays 41 of the extension stations 37. In the extension stations 37, the components of the send and receive relays, 42 and 41 respectively, are connected as in the stations 4 except for the normally closed and normally open contacts, respectively 43 and 44, of the send relay 42 and the receive relay solenoid 40, as mentioned earlier. One side 45 of the solenoid 40 is connected to one side 46 of the master station receive solenoid 39, and the other side 47 of the solenoid 40 is connected to the other side 48 of the solenoid 39. The normally closed contact 43 of the extension station send relay 42 include one contact 49 connected to the terminal 47 of the solenoid 40 and another contact 50 connected to one terminal 51 of the normally open contacts 44. Another terminal 52 of the normally open contacts 44 is connected to the hot power bus 21. The normally open contact 51 is connected to the send-receive line 32. Each additional extension station 37 is connected as has been described above.

The master station 36 and the extension stations 37 are operative to send alarm signals along send-receive line 32 independently of each other. However, in the absence of the detection of smoke by any of the stations of a multiple station, an alert signal received on the send-receive line 32 connected to the multiple station 38 results in the activation of the sounding devices 8 of all of the smoke alarm units 2 of the multiple station 38. In the event that one of the stations of a multiple station 38 detects smoke and issues an alarm signal, an alert signal received along the send-receive line 32 by the multiple station 38 is prevented from activating the sounding devices 8 of any of the smoke alarm units 2 of the multiple station 38.

Returning to FIG. 1, the panel section switching means 30 of the control panel 3 may be either solid state switching members or relays. In the illustrated embodiment the panel section switching means 20 are relays generally similar to those in the station switching means 19, and each includes an operating solenoid, a pair of normally closed contacts, and a pair of normally open contacts. Each panel section switching means 20 includes a receive relay 55 and a send relay 56. The receive relay 55 includes an operating solenoid 57, a pair of normally closed (NC) contacts 58 and a pair of normally open (NO) contacts 59. each send relay 56 includes an operating solenoid 60, a set of normally closed contacts 61, and a set of normally open contacts 62.

The panel receive solenoid 57 is connected on one side to the neutral power bus 22 and on the other side to one of the normally closed contacts 61 of the panel send relay 56. The other normally closed contact 61 is connected to the send-receive line 32, with a fuse 63 preferably included in the send-receive line 32. One of the panel receive relay normally closed contacts 58 is connected to the hot power bus 21, with the other contact 58 being connected to one side of the panel send relay solenoid 60. One side of the receive relay normally open contacts 59 is connected to the neutral power bus 22, with the other normally open contact 59 being connected to a panel alarm 64. One of the panel send relay normally open contacts 62 is connected to the send-receive line 32, with the other contact 62 connected to the hot power bus 21. The alarm location light 5 is connected between the neutral power bus 22 and the send-receive line 32.

Whenever the send-receive line 32 has a voltage of 115 volts thereon, as a result of an alarm signal sent by a respective station, the panel receive relay solenoid 57 is energized through the closed contacts 61. Energization of the solenoid 57 changes the state of the contacts 58 and 59. Closure of the normally open contacts 59 completes the circuit for the panel alarm 64 to the neutral power bus 22 thereby activating the panel alarm 64. In addition to energizing the solenoid 57, an alarm signal on a send-receive line 32 activates the associated alarm location light 5, thereby giving the location of the origin of the alarm signal.

The panel alarm 64 is an audible type of alarm indicator and is employed to call attention to the reception of an alarm signal to a person monitoring the control panel 3. Preferably, the alarm 64 is a bell, buzzer, or the like with sufficient loudness that the panel alarm may be heard from some distance away. It is desirable to include a normally closed switch 65 in one of the conductors to the panel alarm for deactivation of same after notice of the alarm signal, so that the person monitoring the control panel 3 may either determine the seriousness of the situation without unduly alarming other persons in the vicinity of the control panel 3 of so that a call may be placed to a fire department without interference from the panel alarm.

In the event that an alarm signal is received from one station, if the situation warrants, an alert signal may be sent to other stations by actuation of the appropriate alert means 6. The smoke alarm network 1 has the capability of sending alert signals to individual stations, to groups of stations, or to all of the stations not communicating an alarm signal to the control panel 3. Each panel section send relay solenoid 60 is connected on one side to the hot power bus 21 through a set of normally closed contacts 58. An alert signal in the illustrated smoke alarm network 1 is initiated by completion of the circuit of a respective solenoid 60 to the neutral power bus 22 through normally open switch contacts in the alert means 6. Energization of the panel send relay solenoid 60 changes the state of the contacts 61 and 62 associated therewith. Closure of the normally open contacts 62 connects the associated send-receive line 32 to the hot power bus 21, thereby constituting an alert signal.

It may be seen by reference to FIG. 1 that whenever the panel receive relay normally closed contacts 58 are opened, the send solenoid 60 is prevented from being actuated, whereby it is impossible to send an alert signal to a station communicating an alarm signal to the control panel 3. Similarly, whenever the send relay normally closed contacts 61 are opened, the receive solenoid 57 is prevented from being energized, whereby, conversely, it is impossible for a station being alerted to send an alarm signal to the control panel 3.

The alert means 6 includes a general alert actuator switch 71 and may include group alert switches 72 (FIG. 4) and station alert switches 73. In its simplest embodiment, a station alert actuator could be a simple, normally open switch operable to connect a respective station alert conductor 74 (FIG. 1) to the neutral power bus 22 for energizing a respective panel section send relay solenoid 60. Each alert conductor 74 is connected to one terminal 75 of a respective send relay solenoid 60. However, in the illustrated embodiment, the station alert switches 73 are employed to activate respective relays 76 to accomplish the actual switching. Each relay 76 includes an energizing solenoid 77 and a pair of normally open contacts 78, one of the contacts 78 being connected to the neutral power bus 22 and the other being connected to a respective alert conductor 74.

In addition, station alert switching members 79 may include a delay mechanism whereby the contacts 78 remain closed a given length of time after release of the alert actuator switch 73. The delay mechanism 80 may be any suitable type of timer, and illustrated as a time delay relay including a delay solenoid 81, a normally open switch 82, and a mechanical delay unit, indicated at 83, mechanically connected to the switch 82 and magnetically coupled to the delay solenoid 81. The delay unit 83 may be a pneumatic bellows which is extended when the delay solenoid 81 is energized and which closes the normally open switch 82 upon extension and is resiliently urged to collapse upon termination of the magnetic influence of the solenoid 81 by release of the alert switch 73. The bellows (not shown) includes an adjustable valve (not shown) which controls the rate of collapse of the bellows.

When the delay mechanism 80 is employed, the alert switch 73 is used to control actuation of the delay solenoid 81 and the delay switch 82 is used to control energization of the alert solenoid 77.

The general alert switching means 84 includes a delay mechanism 85, similar to the delay mechanism 80, employed with the general alert switch 71, wherein the switch 71 is closed to energize the solenoid 86 thereof for extending the bellows (not shown) of the mechanical delay unit, indicated at 87. The delay unit 87 is mechanically connected to a switch 88. The switch 88 controls current to a plurality of relays 89. Closure of the switch 88 energizes the solenoids 90 of the relays 89 which in turn causes closure of the normally open switches 91. In the illustrated network 1, one contact 92 of each switch 91 is connected to the hot power bus 21. The other contacts 93 are connected to the solenoids 77 of respective station alert relays 76. Connection of the station alert solenoids 77 to the hot power bus 21 energizes the solenoids 77 whereby the switches 78 close and connect the alert conductors 74 to the neutral power bus 22, thereby constituting alert signals on the conductors 74 as detailed above.

While three general alert solenoids 90 and normally open switches 91 are illustrated, one corresponding to each station illustrated, a type of relay having a single solenoid and three simultaneously closing switches could be employed. The switches 91 may be grouped with the solenoids 90 in any practical or convenient manner as long as the switches 91 act substantially simultaneously.

Figure 4:
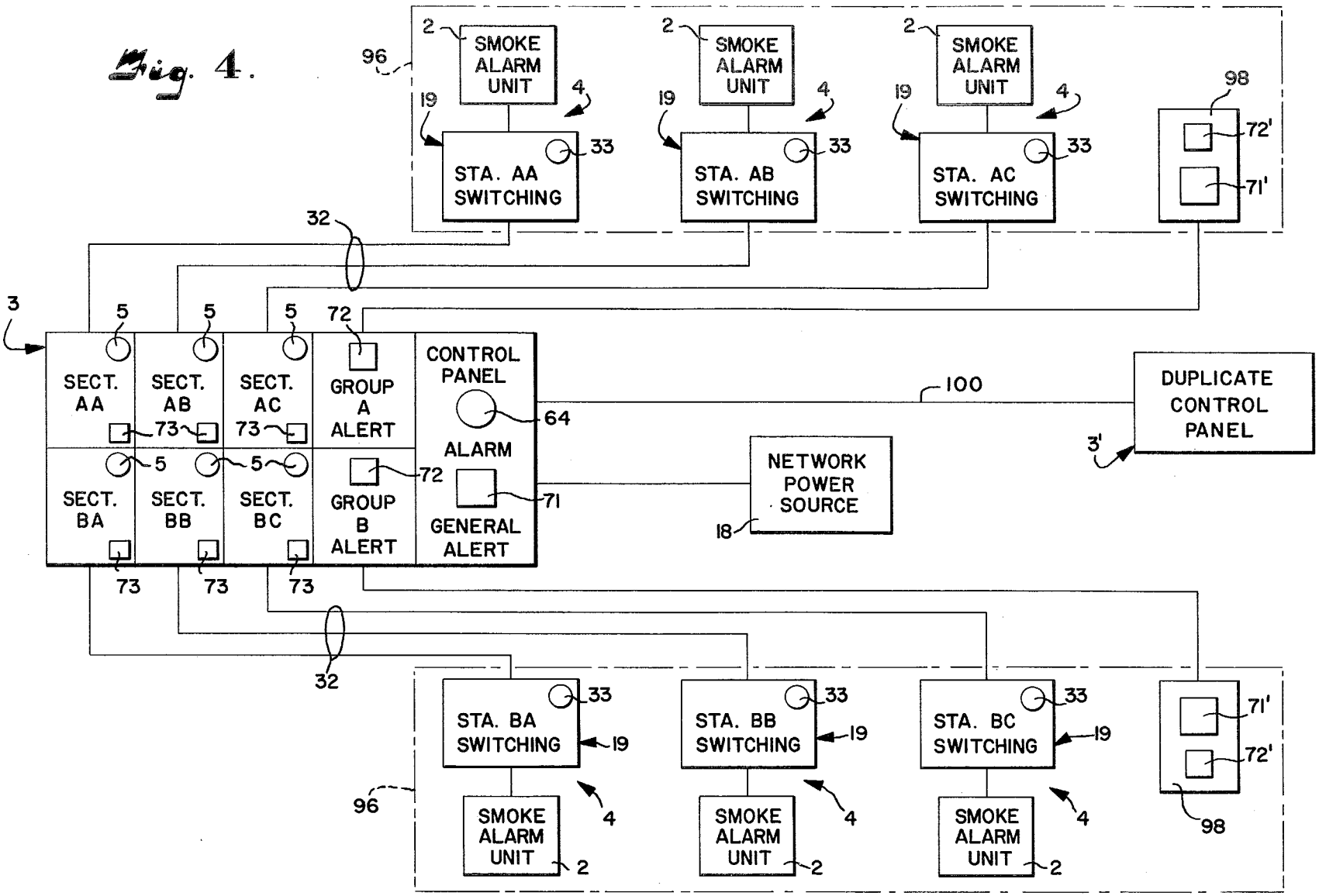
FIG. 4 is a block diagram showing groups of stations and showing remote alert switches and a remote, duplicate control panel.

FIG. 4 illustrates the network 1 with the inclusion of group alert switches 72. In a hotel having many floors, for example, it would be desirable to group the rooms of each floor such that a whole floor could be alerted without alerting each station individually or without unnecessarily alerting the whole building at once. For this purpose, the stations 4 of a floor, or according to any other suitable scheme, are arranged in station groups 96. For ease of monitoring, the sections of the control panel 3 are also grouped in correspondence to the grouping of the stations 4.

The group alert switches 72 may be connected to the station alert switching members 79 in a manner similar to that described for the general alert switch 71, whereby actuation of the group alert switch 72 causes simultaneous alerting of all stations 4 in the group 96 except any that might be issuing alarm signals.

It is desirable to include a general alert switch 71 in addition to the group alert switches 72 for quick alerting procedure when necessary. When group alert switches 72 are employed, the general alert switching means 84 may either be connected for simultaneous actuation of individual station alert switching members 79, or, preferably, for the simultaneous actuation of group alert switching members (not shown), each then actuating the individual stations alert switching members 79.

The smoke alarm network 1 may include remote alert switch sets 98, each including a remote general alert switch 71' and a remote group alert switch 72'. The remote switches 71' and 72' are preferably normally open, momentary contact switches connected in parallel respectively with the general alert switch 71 and the appropriate group alert switch 72. It is preferable to install the remote alert switch sets 98 close to the stations 4 of the respective group 96. For example, in the hotel example mentioned earlier, a remote alert switch set 98 would be installed on the floor corresponding to the group of stations controlled by the particular remote group alert switch 72'. In the event that a station of a group communicates an alarm signal to the control panel 3, the person monitoring same could go to the appropriate location and investigate the situation. If the situation warranted, either a general alert or a group alert could be issued without the delay of returning to the control panel, by actuation of the proper switch of the remote alert switch set 98. It is desirable to install the remote alert switch set in such a manner as to prevent or minimize false alarms by unauthorized actuation of the remote switch set 98.

The smoke alarm network 1 may include a duplicate control panel 3', essentially identical to the first described control panel 3. In a plant comprising a number of areas or buildings widely separated, it would be convenient to have more than one monitoring station. It would be unusual for a person to be employed with the single duty of monitoring the control panel 3. Normally, monitoring the panel 3 would be combined with other duties. For example, a watchman might be charged with monitoring the panel 3, in addition to other duties, such as making security checks around the plant. If a single control panel 3 were employed at a large, diverse plant, there might be a considerable interval between the watchman's return to the control panel 3. During that interval an alarm signal might go unnoticed for a critical length of time with serious consequences. With the inclusion of a duplicate control panel 3', or a plurality thereof, the watchman could work from panel to panel, thereby more effectively monitoring the situation. The duplicate control panels 3' may be connected to the main panel 3 by means of cables 100 consisting of the send-receive lines 32 and the hot and neutral power buses 21 and 22 respectively.

It is to be understood that while certain forms of the present invention have been described and illustrated, with regard to specific components and specific interconnections thereamong, the present invention is not to be limited thereto, except insofar as such limitations are included in the following claims.

What we claim and desire to secure by Letters Patent is:

1. A smoke alarm network comprising:

(a) a plurality of stations;

(b) a smoke alarm unit operatively installed at each of said stations, said unit including in a common housing a smoke alarm circuit having an electrical output upon detection of smoke thereby, and an alarm sounding device connected to said circuit within said housing and powered by said electrical output to give audible warning at the station thereof, said smoke alarm unit including means for the remote activation of said sounding device in the absence of smoke;

(c) a control panel remote from said stations;

(d) alarm indicators on said control panel, said alarm indicators being associated respectively with said stations;

(e) switching means having each smoke alarm circuit, each sounding device and means for remote activation thereof, and each alarm indicator connected thereto, said switching means effecting activation of said alarm indicator in response to the electrical output from said smoke alarm circuit, and said switching means cooperating with the means for remote activation of said sounding device;

(f) a network power source connected to said switching means and providing operating power therefor; and (g) alert switch means on said control panel, connected to said switching means, and operable to effect the remote activation of selected sounding devices not already activated by the electrical outputs of associated smoke alarm circuits.

2. A smoke alarm network as set forth in claim 1 wherein:

(a) said stations are divided into groups; and (b) a group alert switch corresponding to each group of said stations is included on said control panel and is connected to said switching means, each group alert switch being selectively operable to initiate the remote activation of each sounding device of a group if said sounding device has not been activated by the electrical output of an associated smoke alarm circuit.

3. A smoke alarm network as set forth in claim 1 wherein said switching means includes control panel switching means on said control panel and station switching means at each station and wherein:

(a) each station switching means is connected to said control panel switching means and has said network power source operatively connected thereto;

(b) said station switching means includes a send switching portion and a receive switching portion;

(c) each send switching portion is connected to the smoke alarm circuit of the associated station and is operative in response to the electrical output of said smoke alarm circuit to effect activation of an associated alarm indicator; and (d) each receive switching portion is connected to the sounding device of the associated station and is operative in response to operation of said alert switch means to cooperate in the activation of said sounding device in the absence of the electrical output from the smoke alarm circuit of said station.

4. A smoke alarm network as set forth in claim 3 wherein:

(a) each station send switching portion is a relay having the solenoid thereof energized by the electrical output of the associated smoke alarm circuit; and (b) each station receive switching portion is a relay having the solenoid thereof energized in response to operation of said alert switch means in the absence of the electrical output from the associated smoke alarm circuit.

5. A smoke alarm network as set forth in claim 3 wherein said control panel switching means is divided into panel section switching means, each panel section switching means corresponding to a respective station and wherein:

(a) each panel section switching means includes a panel receive switching portion connected to a respective station send switching portion and to one of said alarm indicators and, in response to said electrical output from the associated smoke alarm circuit, is operative to activate said one alarm indicator and to prevent the remote activation of the associated sounding device upon operation of said alert switch means; and (b) each of said panel section switching means includes a panel send switching portion connected to a respective station receive switching portion, said alert switch means, and the respective panel receive switching portion and is operative, in the absence of the electrical output from the smoke alarm circuit associated therewith and in response to operation of said alert switch means, to effect activation of the associated sounding device.

6. A smoke alarm network as set forth in claim 5 wherein:

(a) each panel receive switching portion comprises a relay having the solenoid thereof energized in response to the electrical output of the respective station smoke alarm circuit;

(b) the panel receive switching relay includes normally closed contacts connected to the panel send switching portion associated therewith and opened upon energization of said panel receive switching relay solenoid to prevent activation of the sounding device of the associated station upon operation of said alert switch means, coincident with the electrical output from the associated station smoke alarm circuit;

(c) each panel send switching portion is a relay having the solenoid thereof connected to said alert switch means and to the respective panel receive switching portion and energized upon operation of said alert switch means in the absence of the electrical output from the smoke alarm circuit of the station associated therewith; and (d) the panel send switching relay includes contacts connected to the respective station receive switching portion and operative to activate the associated sounding device upon energization of said panel send switching relay solenoid.

7. A smoke alarm network as set forth in claim 1 wherein:

(a) at least one of said stations is a multiple station including a master station and at least one extension station, said master and extension station each including at least one smoke alarm circuit, one sounding device, and a respective station switching means; and (b) the multiple station switching means are connected to control panel switching means for activation of one of said alarm indicators in response to the electrical output from at least one of the multiple station smoke alarm circuits and for simultaneous activation of all the multiple station sounding devices in response to operation of said alert switch means in the absence of electrical output from any of said multiple station smoke alarm circuits.

8. A smoke alarm network as set forth in claim 1 wherein said alert switch means includes delay means for continuing operation thereof a selected interval after initiation thereof.

9. In a smoke alarm system for a building comprising a plurality of smoke alarm units installed at spaced apart stations in said building, each smoke alarm unit including in a common housing a smoke alarm circuit having an electrical output upon detection of smoke thereby and an alarm sounding device connected to said smoke alarm circuit within said housing and powered by said electrical output to give audible warning at the station thereof, the improvement comprising:

(a) means for the remote activation of said sounding device in the absence of smoke mounted in the smoke alarm unit thereof;

(b) a control panel disposed remote from said stations;

(c) an alarm indicator respectively associated with each station and mounted on said panel;

(d) switching means having each smoke alarm circuit, sounding device and means for remote activation thereof, and alarm indicator connected thereto; said switching means effecting activation of said alarm indicator in response to the electrical output from said smoke alarm circuit, and said switching means cooperating with said means for the remote activation of said sounding device;

(e) a network power source connected to said switching means and providing operating power therefor; and (f) alert switch means on said control panel and connected to said switching means, and operable to effect the remote activation of the sounding devices of selected stations wherein said sounding devices have not already been activated by the electrical outputs of associated smoke alarm circuits.

10. A smoke alarm network as set forth in claim 9 wherein said means for the remote activation of said sounding device includes:

(a) said smoke alarm circuit including an output terminal, a common terminal, and an alert terminal, said electrical output occurring at said alert terminal with respect to said common terminal whenever said circuit is in a ready condition and said electrical output occurring at said output terminal with respect to said common terminal upon detection of smoke by said circuit;

(b) the sounding device associated with said smoke alarm circuit being connected to said output terminal and said common terminal and being activated upon the occurrence of said electrical output at said output terminal;

(c) said switching means being connected to the output, common, and alert terminals of each of said stations; and (d) operation of said alert switch means effecting connection of said alert terminal to said output terminal thereby activating the associated sounding device at selected stations in the absence of smoke at said selected stations.

* * * * *